US007643771B2

(12) United States Patent
Fukuta

(10) Patent No.: US 7,643,771 B2
(45) Date of Patent: Jan. 5, 2010

(54) DEVELOPER CARTRIDGE AND IMAGE-FORMING DEVICE WITH IMPROVED SEALING

(75) Inventor: Hiroya Fukuta, Nagoya (JP)

(73) Assignee: Brother Kogyo Kabushiki Kaisha, Nagoyo-shi, Aichi-ken (JP)

( * ) Notice: Subject to any disclaimer, the term of this patent is extended or adjusted under 35 U.S.C. 154(b) by 504 days.

(21) Appl. No.: 11/442,415

(22) Filed: May 30, 2006

(65) Prior Publication Data

US 2006/0269317 A1 Nov. 30, 2006

(30) Foreign Application Priority Data

May 30, 2005 (JP) ..... P2005-157779

(51) Int. Cl.
*G03G 15/08* (2006.01)

(52) U.S. Cl. ..... 399/103; 399/102; 399/105; 399/106

(58) Field of Classification Search ..... 399/102, 399/103, 105, 106
See application file for complete search history.

(56) References Cited

U.S. PATENT DOCUMENTS

| | | | | |
|---|---|---|---|---|
| 5,488,462 | A * | 1/1996 | Ishikawa et al. | 399/103 |
| 5,550,617 | A | 8/1996 | Odagawa et al. | |
| 5,585,895 | A * | 12/1996 | Yashiro et al. | 399/103 |
| 5,701,558 | A * | 12/1997 | Kojima | 399/103 |
| 6,032,012 | A * | 2/2000 | Hirono et al. | 399/252 |
| 6,044,237 | A * | 3/2000 | Numagami et al. | 399/104 |
| 6,070,027 | A * | 5/2000 | Kawai et al. | 399/103 |
| 6,181,897 | B1 * | 1/2001 | Kawai | 399/103 |
| 6,185,393 | B1 | 2/2001 | Karakama et al. | |
| 6,336,014 | B1 * | 1/2002 | Sato et al. | 399/103 |
| 6,336,015 | B1 * | 1/2002 | Numagami | 399/104 |
| 6,341,206 | B1 | 1/2002 | Yamaguchi et al. | |
| 6,356,723 | B1 | 3/2002 | Sato et al. | |
| 6,496,669 | B2 | 12/2002 | Sato et al. | |
| 2003/0123899 | A1 * | 7/2003 | Kamimura | 399/103 |
| 2005/0180774 | A1 * | 8/2005 | Ohgoshi et al. | 399/103 |
| 2005/0226650 | A1 * | 10/2005 | Okamoto | 399/103 |
| 2006/0188286 | A1 * | 8/2006 | Yuge | 399/102 |
| 2006/0291895 | A1 * | 12/2006 | Fukuta et al. | 399/103 |

FOREIGN PATENT DOCUMENTS

| | | |
|---|---|---|
| JP | 5-27767 | 4/1993 |
| JP | 7-056439 | 3/1995 |

(Continued)

OTHER PUBLICATIONS

Japanese Office Action, with English Translation, issued in Jp 2005-157779 dated on Aug. 7, 2008.

*Primary Examiner*—David M Gray
*Assistant Examiner*—Ryan D Walsh
(74) *Attorney, Agent, or Firm*—Banner & Witcoff, Ltd.

(57) ABSTRACT

A developer cartridge includes a casing, a developing roller, a sheet member, and a plurality of seal members. The casing accommodates developer and is formed with an opening for communicating inside of the casing with outside thereof. The developing roller is disposed on the opening and is rotatably supported on the casing. The sheet member is disposed between the casing and the developing roller. The plurality of seal members is attached to the sheet member in order to prevent the developer from leaking through the opening.

18 Claims, 12 Drawing Sheets

FOREIGN PATENT DOCUMENTS

| | | |
|---|---|---|
| JP | 7-219407 | 8/1995 |
| JP | 8-02242 | 8/1996 |
| JP | 9-325603 | 12/1997 |
| JP | 11-143225 | 5/1999 |
| JP | 2000352874 | 12/2000 |
| JP | 2000352875 | 12/2000 |
| JP | 2001060040 | 3/2001 |
| JP | 2001-092336 | 4/2001 |
| JP | 2001-356600 | 12/2001 |
| JP | 2002-040778 | 2/2002 |
| JP | 2003-202740 | 7/2003 |
| JP | 2003208019 | 7/2003 |
| JP | 2004139019 | 5/2004 |

* cited by examiner

DEVELOPER CARTRIDGE AND IMAGE-FORMING DEVICE WITH IMPROVED SEALING

CROSS REFERENCE TO RELATED APPLICATIONS

This application claims priority from Japanese Patent Application No. 2005-157779 filed May 30, 2005. The entire content of priority application is incorporated herein by reference.

TECHNICAL FIELD

The present invention relates to an image-forming device such as a laser printer, and a developer cartridge mounted in the image-forming device.

BACKGROUND

In an image-forming device such as a laser printer, an electrostatic latent image is formed on a photosensitive drum, and developer is supplied from a developer cartridge to the latent image, thereby a developer image is carried on the surface of the photosensitive drum. Subsequently, the developer image is transferred onto a sheet of paper, forming an image on the paper.

The developer cartridge is commonly configured of a casing for accommodating developer, a developing roller rotatably supported in the casing for carrying developer within the casing, and a thickness-regulating blade for regulating a layer thickness of developer carried on the developer roller. The casing also has an elongated opening formed therein. The developing roller is disposed so that a portion of the roller is exposed through the opening to confront the surface of a photosensitive drum disposed in the image-forming device. The thickness-regulating blade is a thin plate extending in an axial direction of the developer roller and has the upper end portion supported by the casing and the lower end portion pressed against the surface of the developer roller. As the developing roller rotates, the developer accommodated in the casing is supplied to the surface of the developer roller, passes between the thickness-regulating blade and the surface of the developing roller, thereby maintaining a uniform thickness of developer on the surface of the developing roller. When the developer carried on the surface of the developing roller comes into contact with the surface of the photosensitive drum, the developer is attracted to an electrostatic latent image formed on the surface of the photosensitive drum in order to develop the image into a developer image.

This type of developer cartridge has been conventionally provided with a plurality of sealing members individually disposed around the opening to prevent developer from leaking through the opening. A printer disclosed in the Japanese Patent Application Publication No. 2001-60040 is provided with side seals disposed between each end of the developing roller and the casing to prevent developer from leaking therethrough. The printer is also provided with an upper seal disposed between the thickness-regulating blade and the casing to prevent developer from leaking therethrough.

SUMMARY

However, in the disclosed structure which a plurality of seal members are individually mounted in the developer cartridge, if one of the plurality of seal members is mounted in the developer cartridge with error in its arrangement position, another seal members cannot be correctly mounted in the developer cartridge. Accordingly, each of seal members has to be mounted in the developer cartridge with high accuracy, and it is necessary to take a lot of work for mounting each of seal members in the developer cartridge.

In view of the foregoing, it is an object of the present invention to provide a developer cartridge and image-forming device capable of being mounted the plurality of seal members with high accuracy, and reducing the work for arrangement of the plurality of seal members.

To achieve the above and other objects, one aspect of the present invention provides a developer cartridge including a casing, a developing roller, a sheet member, and a plurality of seal members.

The casing accommodates developer and is formed with an opening for communicating inside of the casing with outside thereof. The developing roller is disposed on the opening and is rotatably supported on the casing. The sheet member is disposed between the casing and the developing roller. The plurality of seal members is attached to the sheet member in order to prevent the developer from leaking through the opening.

In another aspect of the invention, there is provided an image-forming device including a main frame and above-described developer cartridge disposed in the main frame.

DETAILED DESCRIPTION

Figure 1:
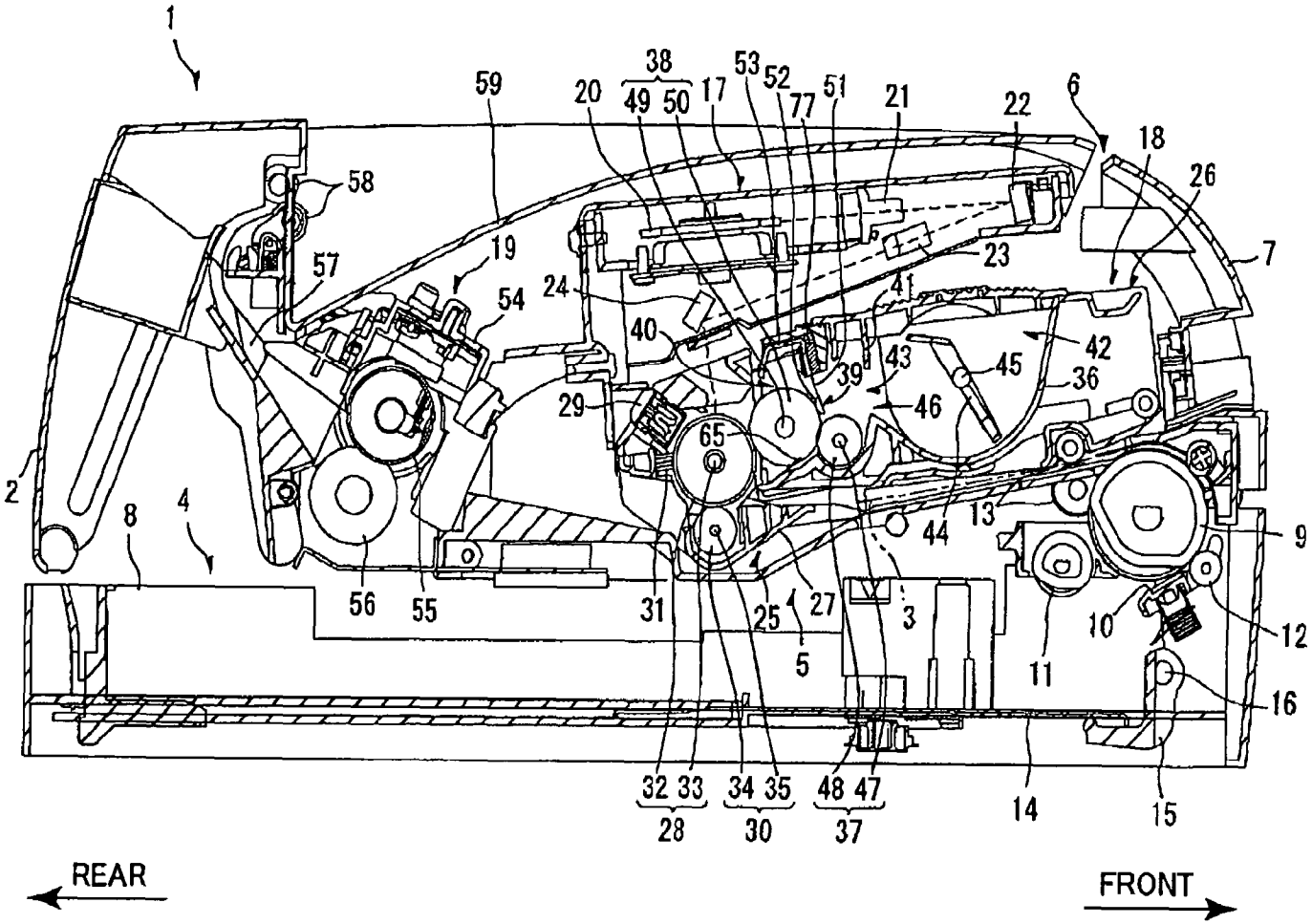
FIG. 1 is a side cross-sectional view of a laser printer according to a preferred embodiment of the present invention, when a cover is in a closed state.

A developer cartridge and an image-forming device according to preferred embodiments of the present invention will be described while referring to the accompanying drawings wherein like parts and components are designated by the same reference numerals to avoid duplicating description.

1. General Structure of a Laser Printer

Figure 2:
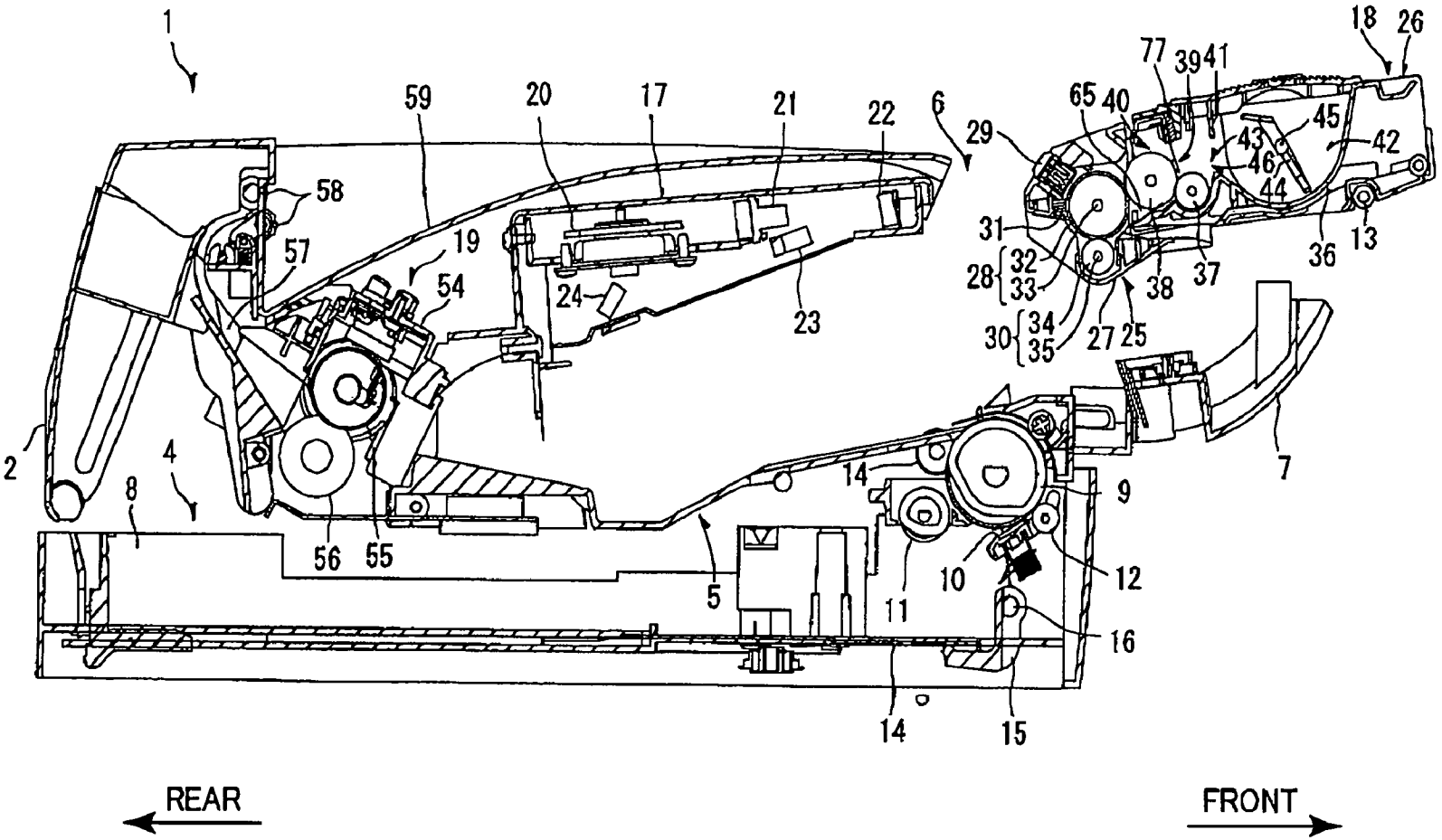
FIG. 2 is a side cross-sectional view of the laser printer in FIG. 1 when the front cover is in an open state.

FIGS. 1 and 2 are side cross-sectional views of a laser printer 1 serving as the image-forming device of the present invention. The laser printer 1 includes a main casing 2 and, within the main casing 2, a feeder unit 4 for supplying sheets of a paper 3, an image-forming unit 5 for forming images on the paper 3 supplied from the feeder unit 4, and the like.

<Main Casing>

An access opening 6 is formed in one side surface of the main casing 2 for inserting and removing a process cartridge 18 described later. A front cover 7 is disposed on the side surface of the main casing 2 and is capable of opening and closing over the access opening 6.

The front cover 7 is rotatably supported by a cover shaft (not shown) inserted through a bottom end of the front cover 7. When the front cover 7 is rotated closed about the cover shaft, the front cover 7 covers the access opening 6, as shown in FIG. 1. When the front cover 7 is rotated open about the cover shaft (rotated downward), the access opening 6 is exposed, as shown in FIG. 2, enabling the process cartridge 18 to be mounted into or removed from the main casing 2 via the access opening 6.

In the following description, the side of the laser printer 1 on which the front cover 7 is provided will be referred to as the "front side," while the opposite side will be referred to as the "rear side." In the state of the process cartridge 18 (and a developer cartridge 26) mounted in the main casing 2, the side of the process cartridge 18 (and the developer cartridge 26) on which the front cover 7 is provided will be referred to as the "front side," while the opposite side will be referred to as the "rear side." Further, a direction orthogonal to both of the front-to-rear direction and the vertical direction will be referred to as the "width direction W."

<Feeding Unit>

The feeder unit 4 includes a paper tray 8 detachably mounted in a lower section of the main casing 2, a feeding roller 9 and separating pad 10 disposed above a front end of the paper tray 8, a pickup roller 11 disposed to the rear side of the feeding roller 9, a pinch roller 12 disposed in confrontation with the feeding roller 9 at the lower front surface thereof, and a pair of registration rollers 13 disposed above and rearward of the feeding roller 9.

A paper-pressing plate 14 is provided inside the paper tray 8 for supporting the paper 3 in a stacked state. The paper-pressing plate 14 is pivotably supported on the rear end thereof, so that the front end can pivot downward to a resting position in which the paper-pressing plate 14 rests on a bottom plate of the paper tray 8 and can pivot upward to a supplying position in which the paper-pressing plate 14 is at a slope.

A lever 15 is provided in the front section of the paper tray 8 for lifting the front end of the paper-pressing plate 14 upward. The lever 15 has a substantially L-shaped cross section in order to bend around the front end of the paper-pressing plate 14 and extend under the bottom surface of the same. The top end of the lever 15 is attached to a lever shaft 16 disposed on the front end of the paper tray 8, while the rear end of the lever 15 contacts the bottom surface of the paper-pressing plate 14 near the front end thereof. When a driving force is inputted into the lever shaft 16, the lever 15 rotates about the lever shaft 16 so that the rear end of the lever 15 lifts the front end of the paper-pressing plate 14 upward, shifting the paper-pressing plate 14 from the resting position to the supplying position.

When the paper-pressing plate 14 is in the supplying position, the topmost sheet of the paper 3 stacked on the paper-pressing plate 14 is pressed against the feeding roller 11. The rotating feeding roller 11 begins feeding the sheets of paper 3 between the separating roller 9 and separating pad 10.

When the paper tray 8 is removed from the main casing 2, the front end of the paper-pressing plate 14 drops downward of its own accord into the resting position. In this state, the paper 3 can be loaded in a stacked state on the paper-pressing plate 14.

When the pickup roller 11 conveys a sheet of the paper 3 between the feeding roller 9 and separating pad 10, the paper 3 becomes interposed between the feeding roller 9 and separating pad 10 by the rotation of the feeding roller 9 and is reliably separated and fed one sheet at a time. The fed sheets of paper 3 pass between the feeding roller 9 and pinch roller 12 and are conveyed to the registration rollers 13.

After adjusting the registration of the paper 3, the registration rollers 13 convey the sheet of paper 3 to a transfer position in the image-forming unit 5 (a position between a photosensitive drum 28 and a transfer roller 30 described later at which a toner image formed on the photosensitive drum 28 is transferred onto the paper 3).

<Image-Forming Unit>

The image-forming unit 5 includes a scanning unit 17, the process cartridge 18, and a fixing unit 19.

(1) Scanning Unit

The scanning unit 17 is disposed in the top section of the main casing 2 and includes a laser light source (not shown), a polygon mirror 20 that can be driven to rotate, a fθ lens 21, a reflecting mirror 22, a lens 23, and a reflecting mirror 24. The laser light source emits a laser beam based on image data. As illustrated by a dotted line in FIG. 1, the laser beam is deflected by the polygon mirror 20, passes through the fθ lens 21, is reflected by the reflecting mirror 22, passes through the lens 23, and is reflected downward by the reflecting mirror 24 to be irradiated on the surface of the photosensitive drum 28 described later of the process cartridge 18 in a high-speed scan.

(2) Process Cartridge

The process cartridge 18 is detachably mounted in the main casing 2 beneath the scanning unit 17. The process cartridge 18 includes a drum cartridge 25, and the developer cartridge 26 that is detachably mounted on the drum cartridge 25.

The developer cartridge 26 can be mounted in or removed from the main casing 2 together with the drum cartridge 25, or can be mounted in or removed from the main casing 2 by itself while the drum cartridge 25 is mounted in the main casing 2.

The drum cartridge 25 includes a drum side casing 27. The developer cartridge 26 is mounted on the front portion of the drum side casing 27. In the rear portion of the drum side casing 27, the drum cartridge 25 includes the photosensitive drum 28, a Scorotron charger 29, the transfer roller 30, and a cleaning brush 31.

The photosensitive drum 28 includes a main drum body 32 that is cylindrical in shape and has a positive charging photosensitive layer formed of polycarbonate or the like on the outer surface thereof, and a metal drum shaft 33 extending along the axial center of the main drum body 32 in the longitudinal direction thereof. The drum shaft 33 is rotatably supported in the drum side casing 27 so that the photosensitive drum 28 can rotate in the drum side casing 27 about the drum shaft 33. During an image-forming process, the photosensitive drum 28 rotates clockwise in FIG. 1.

The charger 29 is supported on the drum side casing 27 diagonally above and rearward of the photosensitive drum 28. The charger 29 is disposed in opposition to the photosensitive drum 28 from a prescribed distance so as not to contact the same. The charger 29 includes a discharge wire and a grid for controlling the amount of corona discharge from the discharge wire that reaches the surface of the photosensitive drum 28 to charge the surface with a uniform positive polarity.

The transfer roller 30 is disposed in the drum side casing 27 beneath the photosensitive drum 28 and opposes and contacts the photosensitive drum 28 to form a nip part therewith. The transfer roller 30 is configured of a metal transfer roller shaft 34 that is covered with a roller 35 formed of an electrically conductive rubber material. The roller shaft 34 is rotatably supported in the drum side casing 27. During a transfer operation, the transfer roller 30 is driven to rotate counterclockwise in FIG. 1, while a transfer bias is applied to the transfer roller 30.

The cleaning brush 31 is disposed rearward of the photosensitive drum 28 so that a tip of the brush is in contact with the surface of the main drum body 32 of the photosensitive drum 28.

The developer cartridge 26 includes a developer side casing 36 and, within the developer side casing 36, a supply roller 37, a developing roller 38, and a thickness-regulating blade 39.

The developer side casing 36 is formed in a box shape having an elongated opening 40 (see FIG. 3) formed in the rear side thereof. A partitioning wall 41 is provided in the developer side casing 36 for partitioning the interior of the developer side casing 36 into a toner-accommodating chamber 42, and a developing chamber 43.

The toner-accommodating chamber 42 is filled with a non-magnetic, single-component toner having a positive charge. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

An agitator shaft 45 is disposed in the center of the toner-accommodating chamber 42 and extends in the width direction W. An agitator 44 is supported on the agitator shaft 45 for rotating about the agitator shaft 45 to stir toner inside the toner-accommodating chamber 42. While agitating toner in the toner-accommodating chamber 42, the agitator 44 discharges some of the toner through an opening 46 formed below the partitioning wall 41 toward the developing chamber 43.

The supply roller 37 is disposed diagonally rearward and below the opening 46. The supply roller 37 includes a metal supply roller shaft 47 that is covered by a sponge roller 48 formed of an electrically conductive foam material. The supply roller shaft 47 is rotatably supported in both side walls of the developer side casing 36 in the developing chamber 43.

The developing roller 38 is disposed rearward of the supply roller 37 and contacts the supply roller 37 with pressure so that both are compressed. The developing roller 38 includes a metal developing roller shaft 49, and a roller 50 formed of an electrically conductive rubber material that covers the developing roller shaft 49. The developing roller shaft 49 is rotatably supported in the developing chamber 43 in both side walls of the developer side casing 36. The roller 50 is more specifically formed of an electrically conductive urethane rubber or silicon rubber containing fine carbon particles or the like, the surface of which is coated with urethane rubber or silicon rubber containing fluorine. A developing bias is applied to the developing roller 38 during a developing operation.

The thickness-regulating blade 39 includes a main blade member 51 configured of a metal leaf spring member, a pressing part 52 provided on a free end of the main blade member 51, and a blade holder 53 for holding the main blade member 51. The pressing part 52 has a semicircular cross section and is formed of an insulating silicon rubber. The main blade member 51 is attached to the blade holder 53 by a screw 83 at a fixed end of the main blade member 51. The thickness-regulating blade 39 is attached to a seal mounting part 67 described later in a state that a blade seal 78 described later is interposed between the thickness-regulating blade 39 and the seal mounting part 67 (see FIGS. 11 and 12). The elastic force of the main blade member 51 causes the pressing part 52 to contact the surface of the developing roller 38 with pressure at a position above the supply roller 37.

During a developing operation, the supply roller 37 rotates counterclockwise in FIG. 2, while the developing roller 38 also rotates counterclockwise in FIG. 2.

During a developing operation, the supply roller 37 rotates counterclockwise in FIG. 2 so that the portion of the supply roller 37 contacting the developing roller 38 rotates downward, while the developing roller 38 also rotates counterclockwise in FIG. 2 so that the portion of the developing roller 38 exposed through the developer side casing 36 rotates downward, while the portion contacting the supply roller 37 rotates upward.

Toner discharged toward the developing chamber 43 through the opening 46 is supplied onto the roller 50 of the developing roller 38 by the rotating supply roller 37. At this time, the toner is positively tribocharged between the sponge roller 48 of the supply roller 37 and the roller 50 of the developing roller 38. As the developing roller 38 rotates, toner supplied to the surface of the roller 50 passes between the roller 50 and the pressing part 52 of the thickness-regulating blade 39, thereby maintaining a uniform thickness of toner on the surface of the developing roller 38.

In the meantime, as shown in FIG. 1, the charger 29 charges the surface of the photosensitive drum 28 with a uniform positive polarity. Subsequently, a laser beam emitted from the scanning unit 17 is scanned at a high speed over the surface of the photosensitive drum 28, forming an electrostatic latent image on the photosensitive drum 28 corresponding to an image that will be formed on the paper 3.

Next, positively charged toner carried on the surface of the developing roller 38 comes into contact with the photosensitive drum 28 as the developing roller 38 rotates and is supplied to areas on the surface of the positively charged photosensitive drum 28 that were exposed to the laser beam and, therefore, have a lower potential. In this way, the latent image on the photosensitive drum 28 is transformed into a visible image according to a reverse development process so that a toner image is carried on the surface of the photosensitive drum 28.

As the registration rollers 13 convey a sheet of the paper 3 through a transfer position between the photosensitive drum 28 and transfer roller 30, the toner image carried on the surface of the photosensitive drum 28 is transferred onto the paper 3 by a transfer bias applied to the paper 3.

Toner remaining on the surface of the photosensitive drum 28 after the transfer operation is recovered by the developing roller 38. Further, paper dust deposited on the photosensitive drum 28 from the paper 3 is removed from the surface of the photosensitive drum 28 by the cleaning brush 31.

(3) Fixing Unit

The fixing unit 19 is disposed rearward of the process cartridge 18 and includes a fixed frame 54; and a heating roller 55 and a pressure roller 56 provided within the fixed frame 54.

The heating roller 55 includes a metal tube, the surface of which has been coated with a fluorine resin, and a halogen lamp disposed inside the metal tube for heating the same. The heating roller 55 is driven to rotate clockwise in FIG. 1.

The pressure roller 56 is disposed below and in opposition to the heating roller 55 and contacts the heating roller 55 with pressure. The pressure roller 56 is configured of a metal roller shaft covered with a roller that is formed of a rubber material. The pressure roller 56 follows the rotational drive of the heating roller 55.

In the fixing unit 19, toner transferred onto the paper 3 at the transfer position is fixed to the paper 3 by heat as the paper 3 passes between the heating roller 55 and pressure roller 56. After the fixing process, the paper 3 is conveyed along a discharge path 57 that extends in a sloped direction toward the top surface of the main casing 2. Discharge rollers 58 are provided at the top end of the discharge path 57. The discharge rollers 58 receive the paper 3 conveyed along the discharge path 57 and discharge the paper 3 onto a discharge tray 59 formed on the top surface of the main casing 2.

Figure 3:
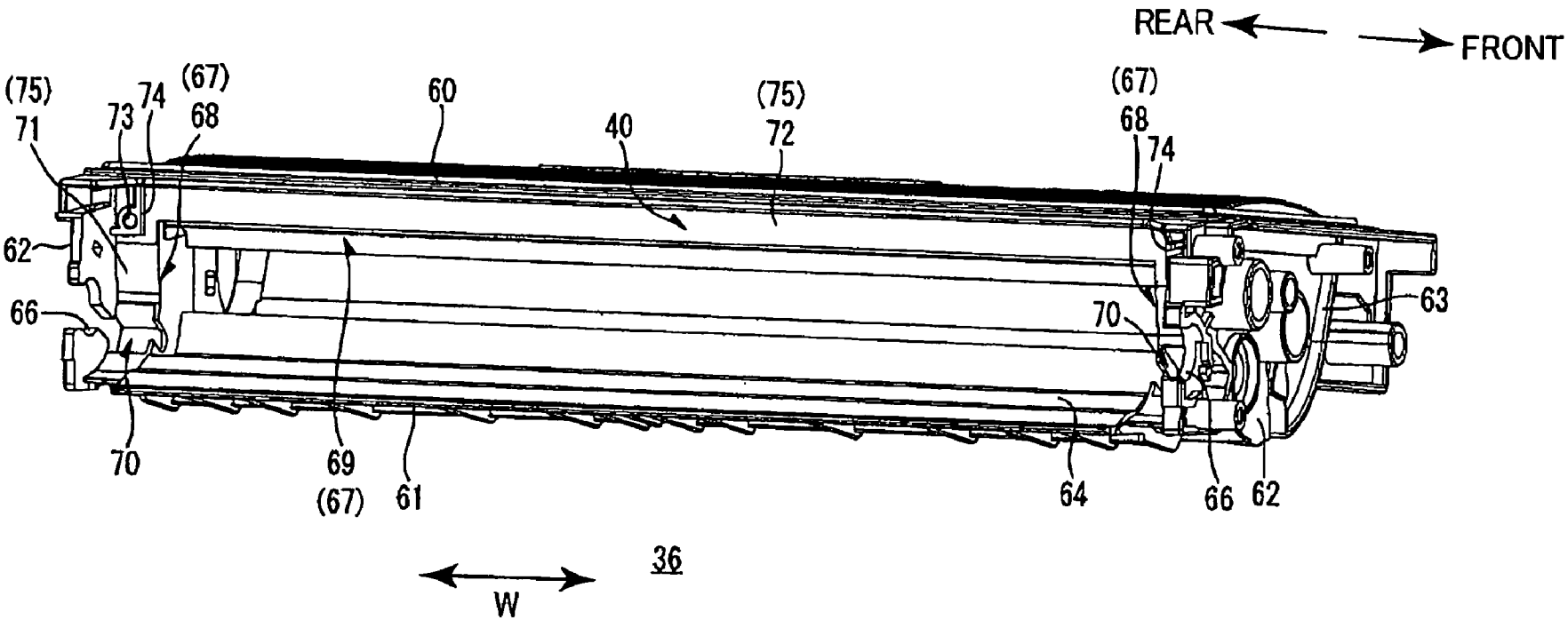
FIG. 3 is a perspective view showing the rear side of the developer side casing of the developer cartridge according to the embodiment of the present invention.
Figure 4:
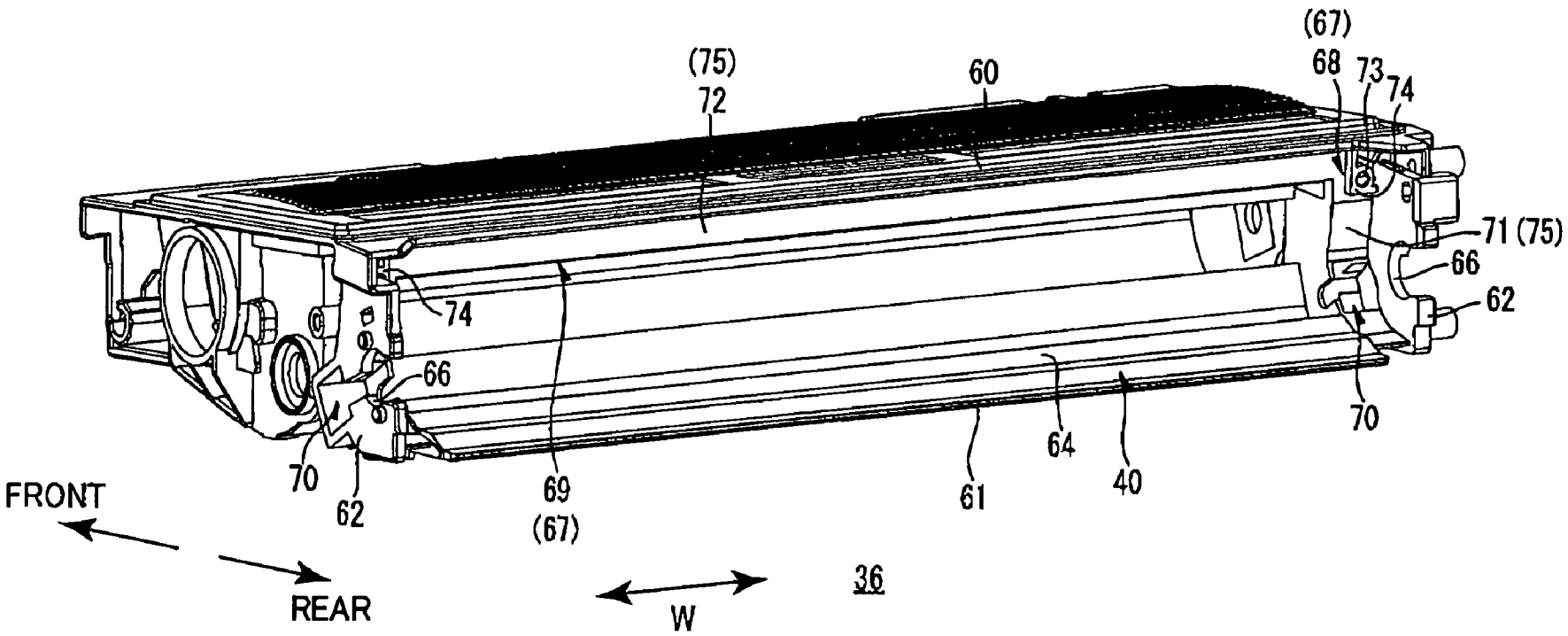
FIG. 4 shows a perspective view of a development side housing of the development cartridge viewed from a direction different from that of FIG. 3.
Figure 5:
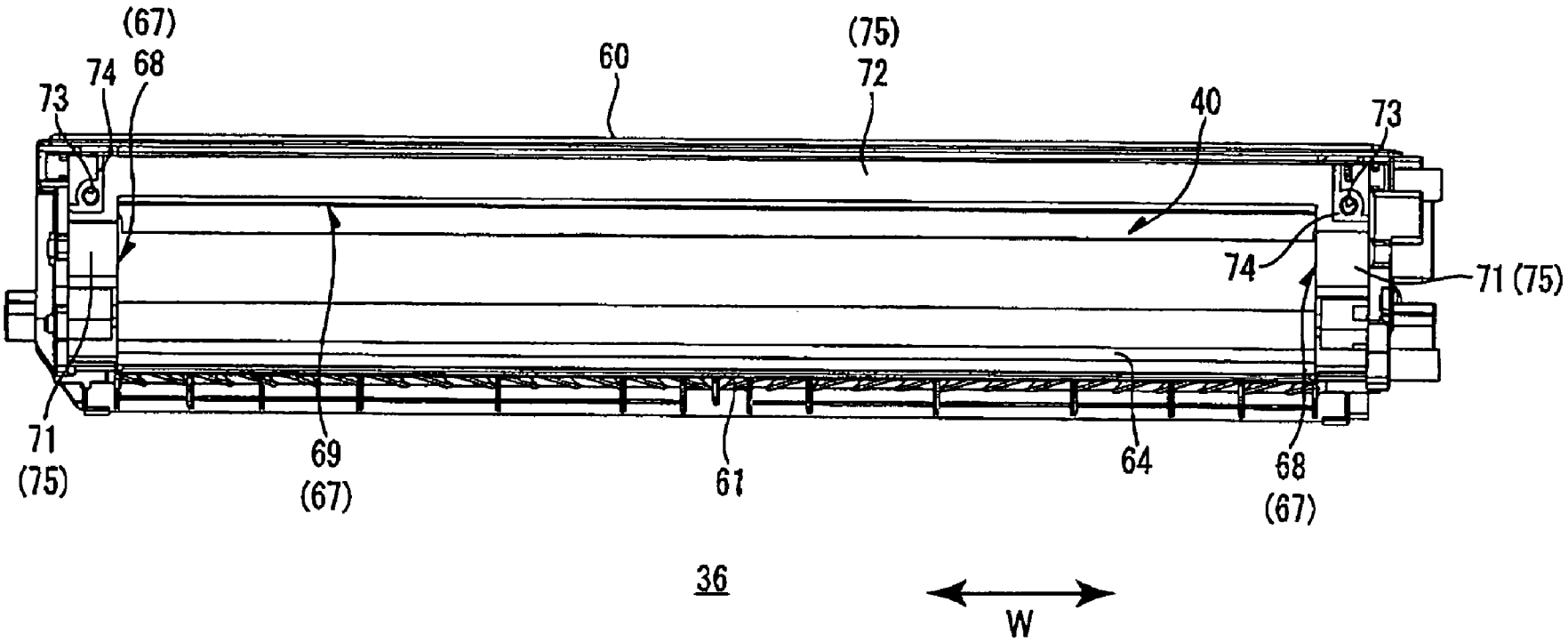
FIG. 5 is a rear view of the developer side casing of the developer cartridge according to the embodiment of the present invention.

2. Detailed Structure of the Developer Side Casing for the Developer Cartridge FIGS. 3 through 5 show the rear side of the developer side casing 36 of the developer cartridge 26 in a state that side seals 76, the blade seal 77, and a sheet member 80 (FIGS. 9 and 10) described later are not attached to a seal mounting part 67 described later of the developer side casing 36. FIG. 3 is a perspective view showing the rear side of the developer side casing 36 of the developer cartridge 26. FIG. 4 is a perspective view showing the rear side of the developer side casing 36 of the developer cartridge 26 viewed from a direction different from that of FIG. 3. FIG. 5 is a rear view of the developer side casing 36 of the developer cartridge 26.

<Developer Side Casing>

The developer side casing 36 of the developer cartridge 26 includes a top wall 60 and bottom wall 61 that oppose each other vertically; a pair of side walls 62 for closing off the widthwise sides of the developer side casing 36 between the top wall 60 and bottom wall 61; and a front wall 63 for closing off the front side of the developer side casing 36 between the top wall 60 and bottom wall 61. The opening 40 elongated in the width direction W is defined by the top wall 60, the bottom wall 61, and rear side of the side walls 62.

The top wall 60 is plate-shaped and wider than the distance between the opposing side walls 62 so as to span between the upper edges of the side walls 62.

Figure 7:
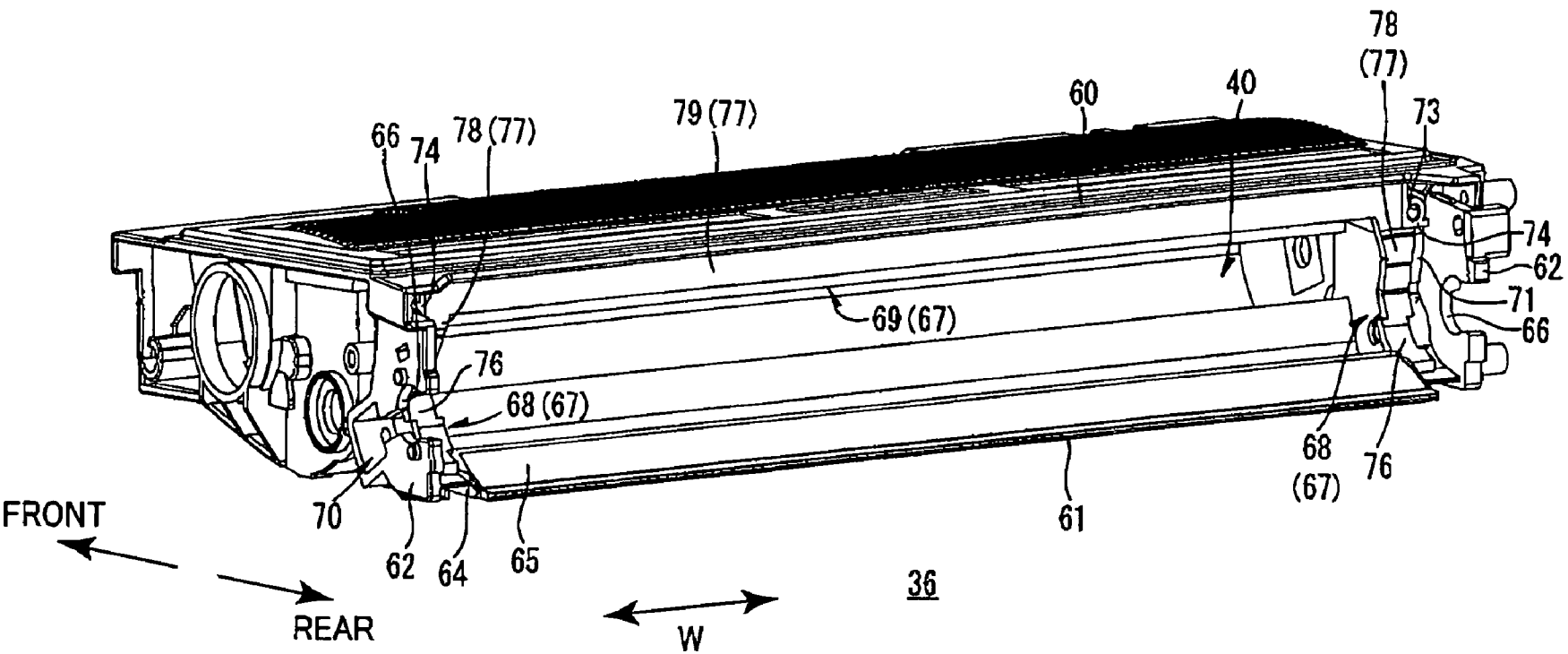
FIG. 7 is a perspective view showing the rear side of the developer side casing, in which side seals and a blade seal are mounted, of the developer cartridge viewed from a direction different from that of FIG. 6.

As shown in FIG. 3, the front end of the bottom wall 61 extends diagonally upward and forward and is formed continuously with the front wall 63. A film mounting part 64 is formed on the upper rear surface of the bottom wall 61 extending in the axial direction of the developing roller 38. As shown in FIG. 7, a lower film 65 is provided on the film mounting part 64. As shown in FIG. 1, the lower film 65 is formed of, for example, PET (polyethylene terephthalate) for sliding against the peripheral surface of the roller 50 on the developing roller 38 while contacting this surface uniformly across the entire width of the roller 50. By sliding uniformly over the peripheral surface of the roller 50 at a position above the bottom wall 61, the lower film 65 can prevent toner from leaking through the bottom wall 61 and the developing roller 38.

As shown in FIGS. 3 through 5, a bearing hole 66 is formed in the rear side of each supporting plate 69 for receiving the developing roller shaft 49 of the developing roller 38. The bearing hole 66 is U-shaped in a side view. The bearing hole 66 opens on the rear side in order to receive the developing roller shaft 49 of the developing roller 38 through this opening.

The seal mounting part 67 for mounting the side seals 76 and blade seal 77 is provided on the opening 40. The seal mounting part 67 includes a pair of side parts 68 and a connecting part 69 for coupling the pair of side parts 68. The pair of side parts 68 is disposed adjacent to inner surfaces of the pair of side walls 62. The coupling part 69 is disposed adjacent to inner surface (lower surface) of the top wall 60, and couples upper ends of the pair of side parts 68. The seal mounting part 67 configured by the pair of side parts 68 and the connecting portion 69 is U-shaped in the rear view.

Each side part 68 extends vertically along the inner surface of the pair of side walls 62. A recess part 70 is formed in the each side wall 62 for receiving the supply roller shaft 47 of the supply roller 37. The recess part 70 is recessed in each side wall 62 in a direction obliquely forward. The sponge roller 48 of the supply roller 37 is disposed between the pair of side walls 62, while the supply roller shaft 47 is received in the recess part 70. The pair of side parts 68 oppose the peripheral surface of the roller 50 on widthwise ends of the developing roller 38 in the axial direction thereof, while the developing roller 38 is disposed between the pair of side walls 62. An opposing surface 71 of each side part 68, which opposes the peripheral surface of the roller 50, in regions other than the recess part 70 has a smooth surface having no step.

It is noted that a sponge member (not shown) is disposed on the recessed part 70 to fill a gap between the supply roller shaft 47 and a surface of the recessed part 70 when the supply roller shaft 47 is received.

The connecting part 69 extends in the width direction W along the inner surface of the top wall 60, and has a smooth surface 72 that forms a flat surface together with the opposing surfaces 71 of the pair of side parts 68 without forming a step. As shown in FIG. 5, fixing portions 74 are provided on both end of the smooth surface 72 in the width direction W. Each of fixing portions 74 is formed with a screw hole 73 for fixing the thickness-regulating blade 39. As shown in FIG. 3, each of the fixing portions 74 protrudes from the smooth surface 72 toward the rear side, thereby forming a step between each of the fixing portions 74 and the smooth surface 72.

Each of the opposing surfaces 71 of the side parts 68 in regions other than the recess portions 70, and the smooth surface 72 of the connecting part 69 in regions other than the fixing portions 74 form a planar surface 75 with no step. That is, each of the opposing surfaces 71 in regions other than the recess portions 70 forms the planar surface 75 together with the smooth surface 72 in regions other than the fixing portions 74 without forming a step.

Figure 6:
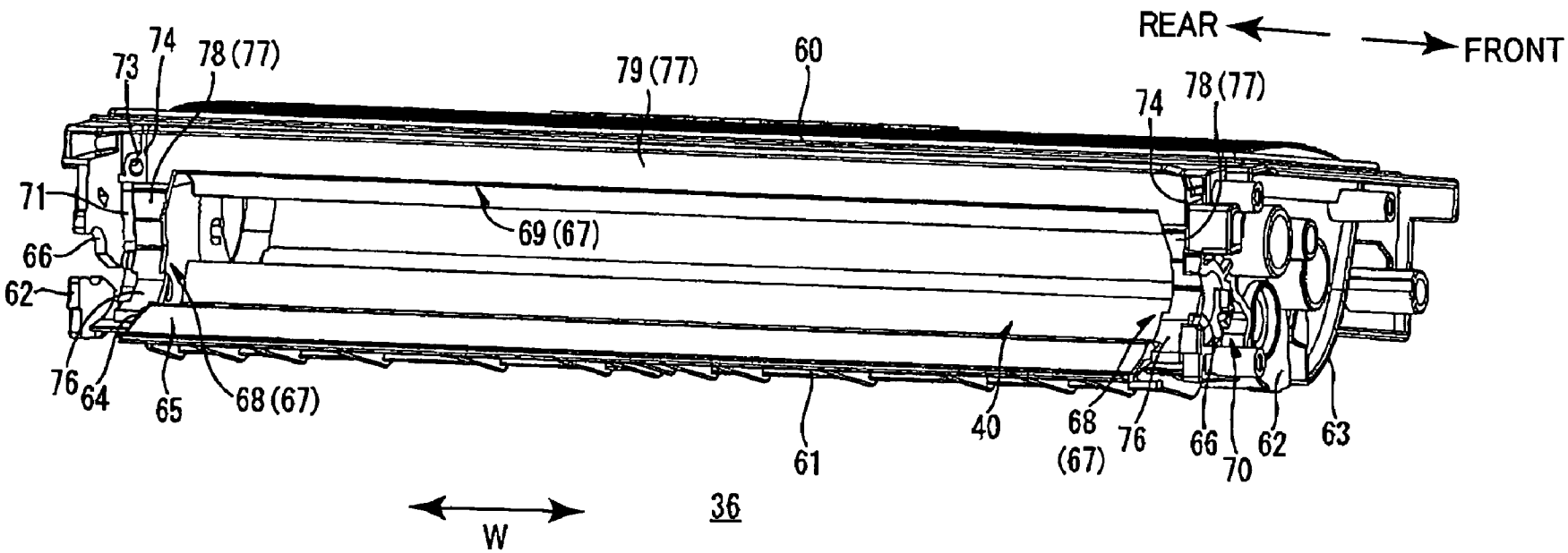
FIG. 6 is a perspective view showing the rear side of the developer side casing, in which side seals and a blade seal are mounted, of the developer cartridge according to the embodiment of the present invention.
Figure 10:
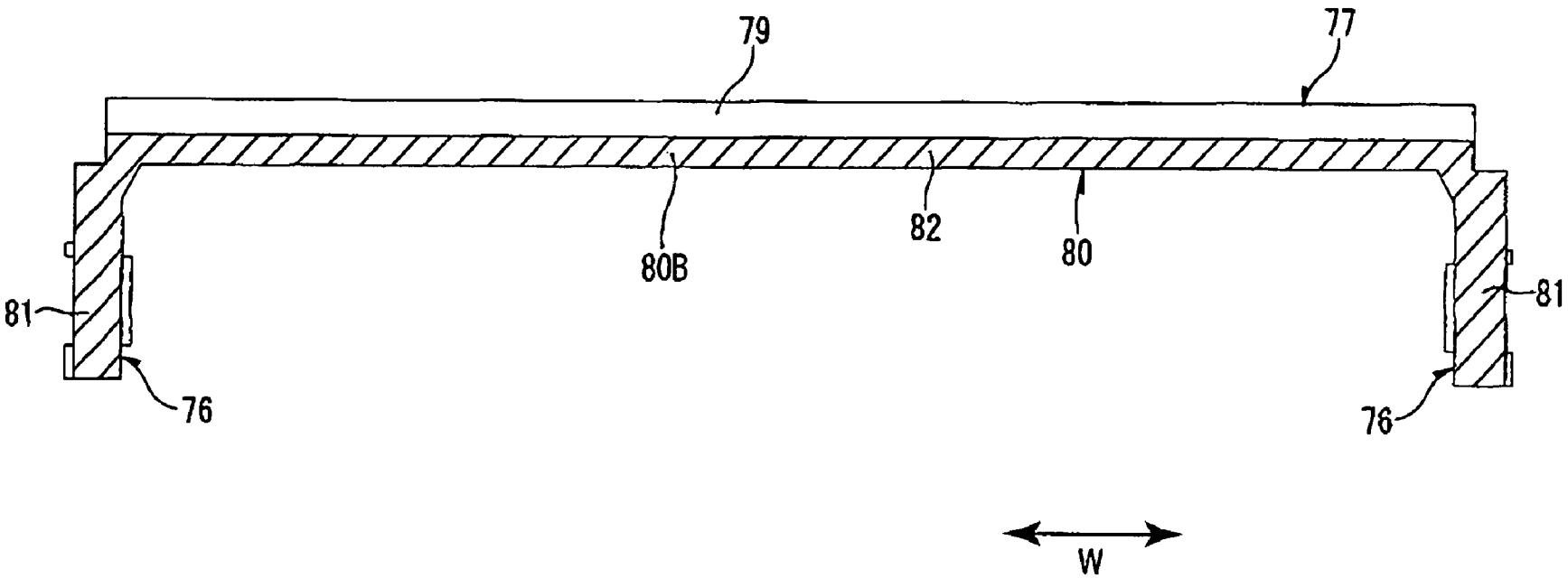
FIG. 10 is a view showing another side surface of the side seals, the blade seal and the sheet member opposing the seal mounting part according to the embodiment of the present invention.

As shown in FIGS. 6 and 7, the side seals 76 and the blade seal 77 are mounted in the seal mounting part 67 in a state that the side seals 76 and the blade seal 77 are attached to and integrally retained by the sheet member 80 (see FIG. 10).

Figure 8:
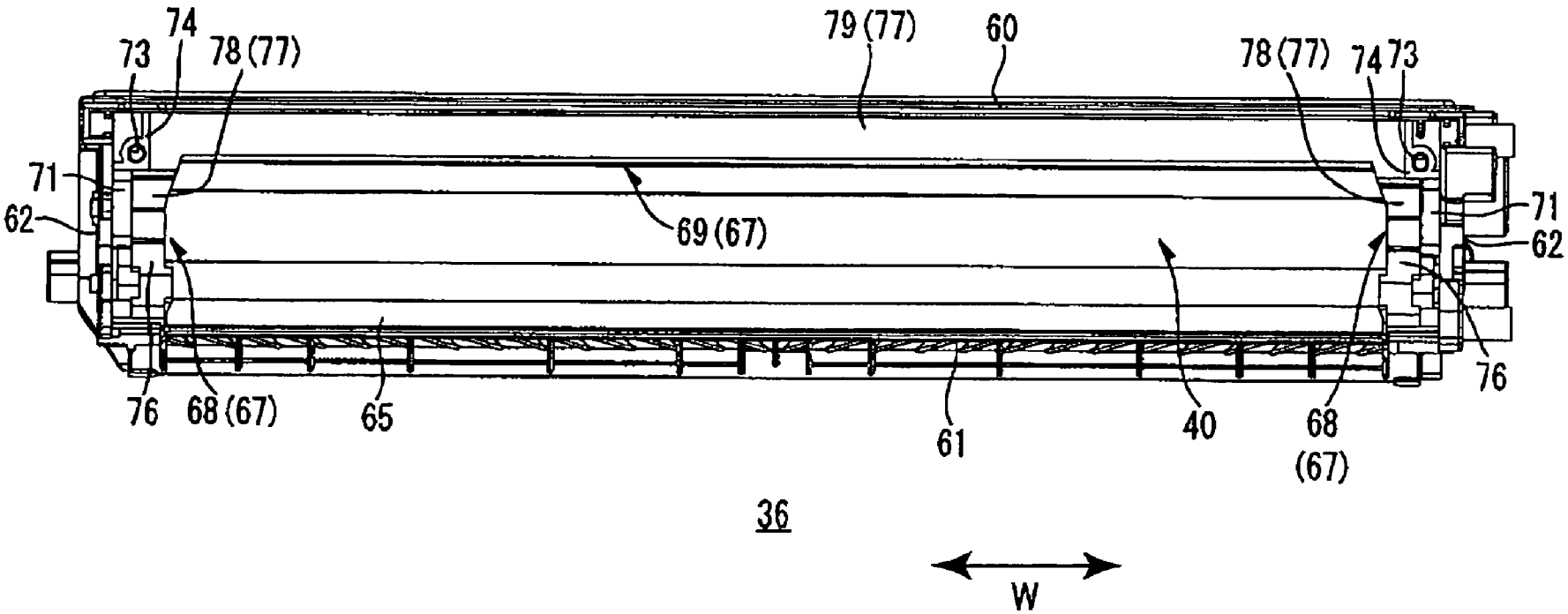
FIG. 8 a rear view of the developer side casing, in which side seals and a blade seal are mounted, of the developer cartridge according to the embodiment of the present invention.
Figure 9:
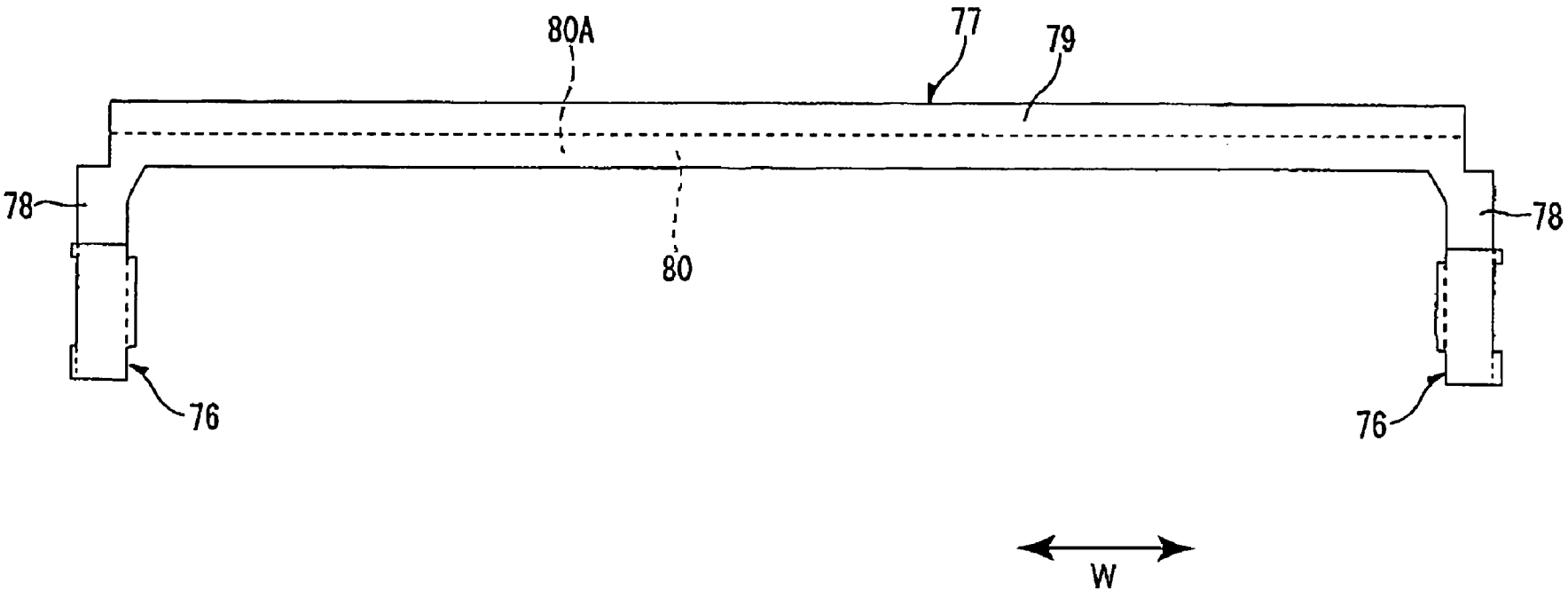
FIG. 9 is a view showing one side surface of the side seals, the blade seal and a sheet member opposing the developing roller and the thickness-regulating blade according to the embodiment of the present invention.

FIGS. 6 through 8 show the rear side of the developer side casing 36 of the developer cartridge 26 in a state that side seals 76, the blade seal 77, and the sheet member 80 (FIGS. 9 and 10) are attached to the seal mounting part 67 of the developer side casing 36. FIG. 6 is a perspective view showing the rear side of the developer side casing 36 of the developer cartridge 26. FIG. 7 is a perspective view showing the rear side of the developer side casing 36 of the developer cartridge 26 viewed from a direction different from that of FIG. 6. FIG. 8 is a rear view of the developer side casing 36 of the developer cartridge 26. Further, FIG. 9 is a rear view of the side seals 76 and the blade seal 77. That is, FIG. 9 is one side surface of the side seals 76 and the blade seal 77 opposing the developing roller 38 and the thickness-regulating blade 39. FIG. 10 is another side surface of the side seals 76 and the blade seal 77 on the side opposite to the one side surface shown in FIG. 9.

<Side Seal>

The side seals 76 are disposed on the opposing surfaces 71 of the pair of side parts 68. The side seals 76 are formed of a sponge material such as urethane foam, extends vertically on the opposing surfaces 71 of the pair of side parts 68 and have a substantially rectangular shape.

<Blade Seal>

The blade seal 77 is disposed over each opposing surface 71 of the pair of side parts 68 and the smooth surface 72 of the connecting part 69. The blade seal 77 is formed of a sponge material, such as urethane foam. As shown in FIG. 8, the blade seal 77 is integrally formed of seal side parts 78 disposed on the upper ends of the opposing surfaces 71 of the pair of side parts 68; and a seal connecting part 79 disposed on the smooth surface 72 of the connecting part 69 for linking upper ends of the seal side parts 78. The blade seal 77 is U-shape in rear view.

Each of seal side parts 78 has a rectangular shape. The lower ends of the seal side parts 78 abut on the upper ends of the side seals 76. The seal connecting part 79 is formed with a same width as the width in the vertical direction of the smooth surface 72 of the connecting part 69, and is formed with a substantially rectangular shape extending in the width direction W. Cutting portions abutting on the fixing portions 74 are formed on both ends of the seal connecting part 79 of the blade seal 77 in the width direction W.

<Sheet Member>

The sheet member 80 is a PET film having flexibility, and has a shape corresponding to the shape of the planar surface 75 including each of the opposing surfaces 71 of the side parts 68 in regions other than the recess portions 70 and the smooth surface 72 of the connecting part 69 in regions other than the fixing portions 74. The sheet member 80 has one surface 80A (FIG. 9) and another surface 80B (FIG. 10) on the opposite side of the one surface 80A.

Specifically, as shown in FIG. 10, the sheet member 80 with hatching has a pair of sheet side parts 81 and a sheet connecting part 82. Each of sheet side parts 81 has a substantially same width as the width in the width direction W of the side seals 76 and the seal side parts 78 (FIG. 9). The side seals 76 and the seal side parts 78 are attached to the sheet side parts 81. The sheet connecting part 82 connects upper ends of the sheet side parts 81. The sheet connecting part 82 has a substantially same width in the vertical direction as half of the width in the vertical direction of the seal connecting part 79. The lower half of the seal connecting part 79 is attached to the sheet connecting part 82. Cutting portions abutting on the fixing portions 74 are formed on both ends of the sheet member 80 (the sheet connecting part 82) in the width direction W.

<Attaching the Side Seals 76 and Blade Seal 77 to the Developer Side Casing 36>

Figure 11:
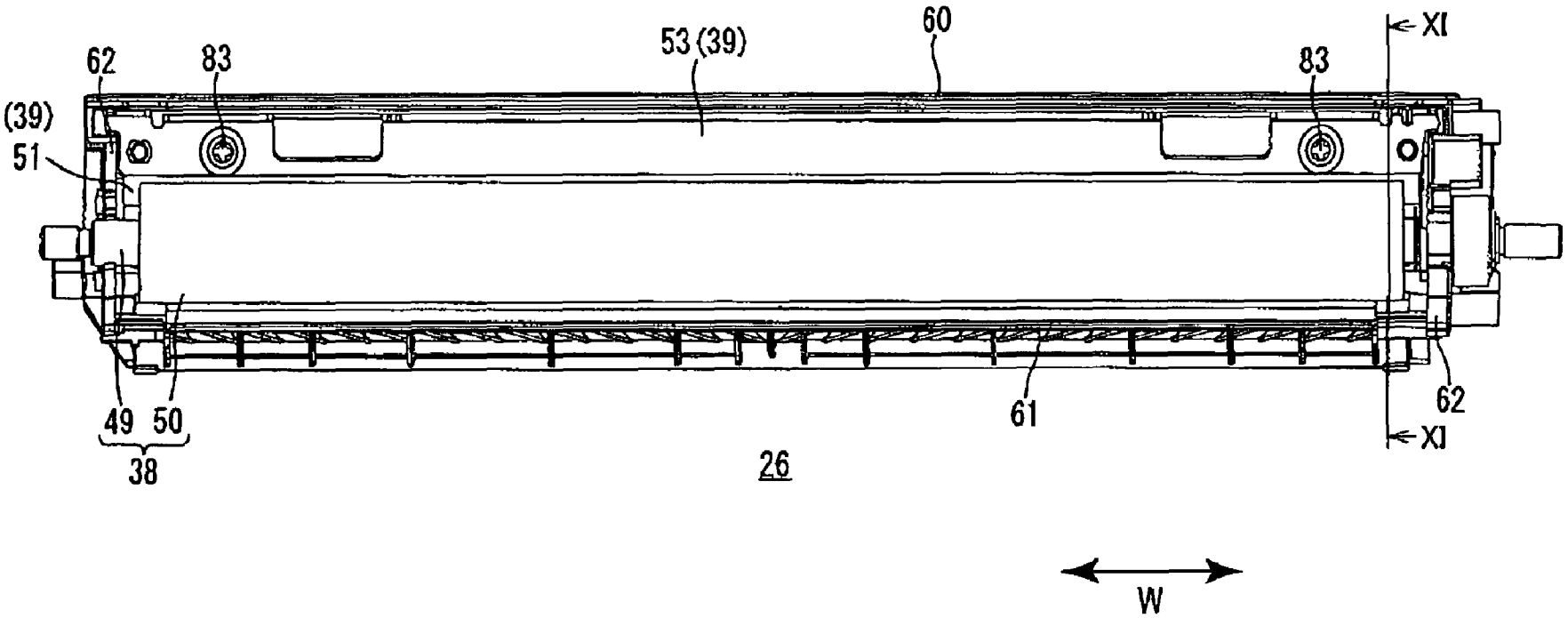
FIG. 11 is a rear view of the developer cartridge according to the embodiment of the present invention.
Figure 12:
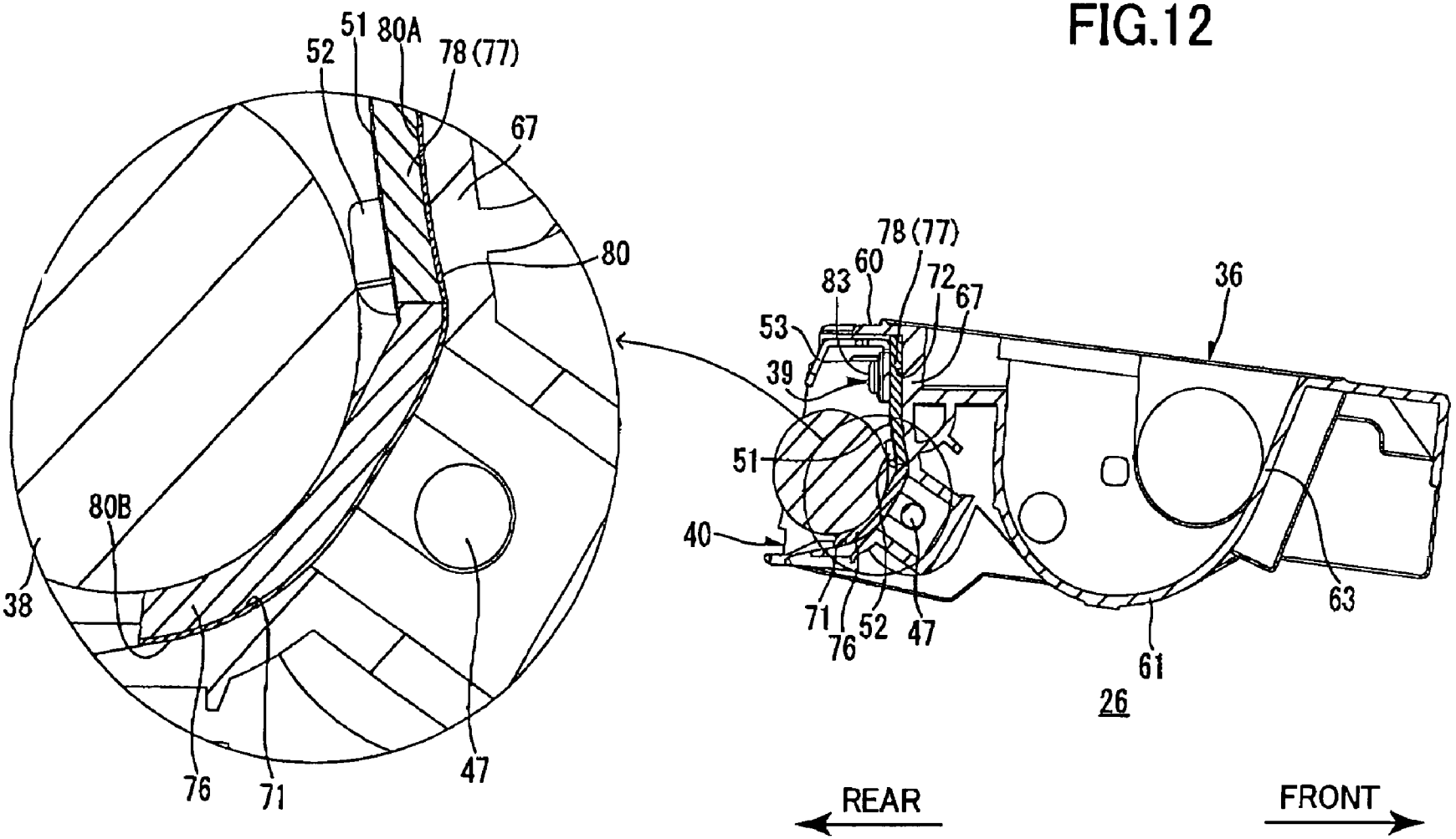
FIG. 12 is a cross-sectional view of the developer cartridge along a line XI-XI in FIG. 11.

FIG. 11 is a rear view of the developer cartridge 26. FIG. 12 is a cross-sectional view of the developer cartridge 26 along a line XI-XI in FIG. 11.

Firstly, the side seals 76 and the blade seal 77 are attached to one surface 80A of the sheet member 80 that is not mounted in the developer side casing 36. For example, the blade seal 77 is attached to one surface 80A of the sheet member 80 in advance such that the lower half of the seal connecting part 79 is disposed on the sheet connecting part 82 and the seal side parts 78 is disposed on the sheet side parts 81. Next, the side seals 76 are attached to the one surface 80A of the sheet member 80. At this time, each of the side seals 76 is attached to each of the sheet side parts 81 with one end of each of the side seals 76 being located on the lower end of each of the sheet side parts 81, and with the other end of each of the side seals 76 being slightly pressed against the lower end of each of the seal side parts 78. Accordingly, the side seals 76 and the seal side parts 78 of the blade seal 77 are pressed against each other with pressure without forming a gap therebetween.

Next, the another surface 80B of the sheet member 80 is came into contact with the planar surface 75 (FIG. 5) of the seal mounting part 67 such that the cutting portions of the blade seal 77 abut on the fixing portions 74. Thus, as shown in FIG. 8, the cutting portions of the blade seal 77 abut on the fixing portions 74, and the side seals 76 and the blade seal 77 are disposed on the seal mounting part 67 with being positioned at least in the width direction W.

Next, the thickness-regulating blade 39 is disposed on the blade seal 77 such that the upper end of the main blade member 51 opposes the seal connecting part 79 of the blade seal 77 disposed on the seal mounting part 67. Then, the upper end of the main blade member 51 is pressed against the seal connecting part 79 of the blade seal 77, and a screw (not shown) is penetrated through the thickness-regulating blade 39 and threadingly engaged with the screw hole 73 formed in the fixing portions 74 of the developer side casing 36. Thus, the thickness-regulating blade 39 is fixed to the developer side casing 36. Subsequently, the developing roller shaft 49 of the developing roller 38 is mounted in the bearing holes 66 of the pair of side walls 62 of the developer side casing 36, and is rotatably supported in the developer side casing 36. Thus, the blade seal 77 is pinched between the thickness-regulating blade 39 and the planar surface 75 of the seal mounting part 67 with pressure. Accordingly, the blade seal 77 elastically presses against the thickness-regulating blade 39 and the seal mounting part 67, thereby preventing toner from leaking through the thickness-regulating blade 39 and the planar surface 75 of the seal mounting part 67.

On the other hand, the side seals 76 are pinched between the peripheral surfaces of the roller 50 on widthwise ends of the developing roller 38 and the opposing surfaces 71 with pressure. Thus, the side seals 76 elastically press against the peripheral surfaces of the roller 50 on widthwise ends of the developing roller 38 and the opposing surfaces 71, and slide against the peripheral surface of the roller 50 on the developing roller 38. Accordingly, the side seals 76 prevent toner from leaking through the end portions of the roller 50 and the opposing surface 71.

3. Operations and Effects of the Preferred Embodiment

As described above, the side seals 76 and the blade seal 77 are mounted in the seal mounting part 67 of the developer side casing 36 in the state that the side seals 76 and the blade seal 77 are attached to and integrally retained by the sheet member 80 having flexibility. Accordingly, the side seals 76 and the blade seal 77 can be mounted in the seal mounting part 67 with high accuracy and reduce a work for arrangement thereof, as compared to individually mounting the side seals 76 and the blade seal 77 in the seal mounting part 67. Further, a work for producing the laser printer 1 can be reduced.

The sheet member 80 has flexibility. Therefore, the sheet member 80 can be deformed in accordance with a shape of the planar surface 75 of the seal mounting part 67, thereby preventing a gap from being formed between the sheet member 80 and the planar surface 75. Accordingly, gaps between the developer side casing 36 (seal mounting part 67), and the developing roller 38 and the thickness-regulating blade 39 can be sealed well, thereby reliably preventing toner from leaking through the opening 40 of the developer side casing 36.

Further, since the side seals 76 and the blade seal 77 are attached to the sheet member 80, the blade seal 77 can be disposed in a planar state in the longitudinal direction of the thickness-regulating blade 39. Due to the flexibility of the sheet member 80, the side seals 76 can be disposed on the seal mounting part 67 in a curved shape along the peripheral surface of the roller 50. Therefore, the side seals 76 can seal well the gap between the developer side casing 36 and the widthwise ends of the developing roller 38, and the blade seal 77 can seal well the gap between the developer side casing 36 and the thickness-regulating blade 39.

Further, since the side seals 76 and the blade seal 77 are attached to the sheet member 80, the side seals 76 and the blade seal 77 can be fixed to the developer side casing 36 by pinching the blade seal 77 between the thickness-regulating blade 39 and the planar surface 75 of the seal mounting part 67 with pressure. Therefore, adhesive tape or adhesive bond is not required for fixing the side seals 76 and the blade seal 77 to the developer side casing 36. Accordingly, when the side seals 76 and the blade seal 77 are removed from the developer cartridge 26 so as to recycle or reuse the developer cartridge 26, the side seals 76 and the blade seal 77 can be easily removed from the developer side casing 36. As a result, the recycling efficiency of the developer cartridge 26 can be improved.

Further, since the sheet member 80 is disposed on the seal mounting part 67 of the developer side casing 36, the side seals 76 attached to the sheet member 80 can be abutted on the peripheral surface of the roller 50 on the developing roller 38. When the developing roller 38 is driven to rotate, the side seals 76 can be slide against the peripheral surface of the roller 50 on the developing roller 38. Accordingly, the side seals 76 prevent toner from leaking between the side seals 76 and the end portions of the roller 50 by rotating the developing roller 38.

Further, since the planar surface 75 of the seal mounting part 67 has no step, the another surface 80B of the sheet member 80 can be closely attached to the planar surface 75. Therefore, toner can be reliably prevented from leaking between the sheet member 80 and the seal mounting part 67.

Further, since the steps are formed between the planar surface 75 of the seal mounting part 67 and the fixing portions 74, the sheet member 80 to which the side seals 76 and the blade seal 77 are attached can be mounted in the planar surface 75 of the seal mounting part 67 based on the steps. Accordingly, the side seals 76 and the blade seal 77 can be mounted in the developer side casing 36 with higher accuracy.

Further, since the shape of the sheet member 80 corresponds to the shape of the planar surface 75 of seal mounting part 67, the sheet member 80 to which the side seals 76 and the blade seal 77 are attached can be mounted in the planar surface 75 of the seal mounting part 67 based on the periphery of the planar surface 75. In this case also, the side seals 76 and the blade seal 77 can be mounted in the developer side casing 36 with higher accuracy.

Furthermore, the sheet member 80 is a PET film having flexibility and does not stretch. Therefore, the sheet member 80 can be deformed in accordance with the shape of the planar surface 75 of the seal mounting part 67, and can be disposed on the planar surface 75 with high accuracy. Accordingly, the arrangement accuracy of the side seals 76 and the blade seal 77 can be more improved, and the gaps between the developer side casing 36, and the developing roller 38 and the thickness-regulating blade 39 can be sealed well.

Moreover, since the developer cartridge 26 can be reliably prevented toner from leaking through the opening 40 of the developer side casing 36, the laser printer 1 can be reliably prevented toner from leaking through the developer cartridge 26.

What is claimed is:

1. A developer cartridge comprising:

a casing that accommodates developer and is formed with an opening for communicating inside of the casing with outside thereof;

a developing roller that is disposed on the opening and is rotatably supported on the casing;

a sheet member that is disposed between the casing and the developing roller;

a plurality of seal members that is attached to the sheet member in order to prevent the developer from leaking through the opening; and a thickness-regulating member that has a first part attached to the casing and a second part that regulates thickness of the developer provided on the developing roller, wherein the developing roller has a rotational shaft defining an axial direction and a peripheral surface, the peripheral surface including a center zone and end zones at both end portions in the axial direction;

the casing has opposing surfaces opposed to the end zones;

the sheet member comprises two first sheet portions and a second sheet portion integrally provided with the first sheet portions, each of the first sheet portions being disposed between each of the end zones and each of the opposing surfaces, the second sheet portion being disposed between the casing and the first part; and the plurality of seal members comprises two first seal members and a second seal member, each of the first seal members being attached to each of the first sheet portions in order to prevent developer from leaking through a space formed between each of the end zones and each of the opposing surfaces, the second seal member being attached to the second sheet portion in order to prevent the developer from leaking through a space formed between the casing and the first part.

2. The developer cartridge according to claim 1, wherein the sheet member has flexibility.

3. The developer cartridge according to claim 1, wherein one end of each of the first seal members contacts the second seal member with pressure.

4. The developer cartridge according to claim 1, wherein the plurality of seal members attached to the sheet member is fixed to the casing by pinching the second seal member between the casing and the first part.

5. The developer cartridge according to claim 1, wherein the sheet member has one surface and another surface on the opposite side of the one surface, the plurality of seal members being attached to the one surface, the another surface contacting the casing.

6. The developer cartridge according to claim 5, wherein the casing includes a seal contacting surface that contacts the another surface of the sheet member, the seal contacting surface forming a planar surface without having a step.

7. The developer cartridge according to claim 6, wherein a step is formed between the seal contacting surface and a surrounding part of the seal contacting surface of the casing.

8. The developer cartridge according to claim 7, wherein the sheet member has a shape corresponding to a shape of the seal contacting surface.

9. The developer cartridge according to claim 1, wherein the sheet member is formed of a PET film.

10. An image-forming device comprising:

a main frame;

a developer cartridge disposed in the main frame, comprising, a casing that accommodates developer and is formed with an opening for communicating inside of the casing with outside thereof;

a developing roller that is disposed on the opening and is rotatably supported on the casing;

a sheet member that is disposed between the casing and the developing roller; and a plurality of seal members that is attached to the sheet member in order to prevent the developer from leaking through the opening;

a thickness-regulating member that has a first part attached to the casing and a second part that regulates thickness of the developer provided on the developing roller, wherein the developing roller has a rotational shaft defining an axial direction and a peripheral surface, the peripheral surface including a center zone and end zones at both end portions in the axial direction;

the casing has opposing surfaces opposed to the end zones;

the sheet member comprises two first sheet portions and a second sheet portion integrally provided with the first sheet portions, each of the first sheet portions being disposed between each of the end zones and each of the opposing surfaces, the second sheet portion being disposed between the casing and the first part; and the plurality of seal members comprises two first seal members and a second seal member, each of the first seal members being attached to each of the first sheet portions in order to prevent developer from leaking through a space formed between each of the end zones and each of the opposing surfaces, the second seal member being attached to the second sheet portion in order to prevent the developer from leaking through a space formed between the casing and the first part.

11. The image-forming device according to claim 10, wherein the sheet member has flexibility.

12. The image-forming device according to claim 10, wherein one end of each of the first seal members contacts the second seal member with pressure.

13. The image-forming device according to claim 10, wherein the plurality of seal members attached to the sheet member is fixed to the casing by pinching the second seal member between the casing and the first part.

14. The image-forming device according to claim 10, wherein the sheet member has one surface and another surface on the opposite side of the one surface, the plurality of seal members being attached to the one surface, the another surface contacting the casing.

15. The image-forming device according to claim 14, wherein the casing includes a seal contacting surface that contacts the another surface of the sheet member, the seal contacting surface forming a planar surface without having a step.

16. The image-forming device according to claim 15, wherein a step is formed between the seal contacting surface and a surrounding part of the seal contacting surface of the casing.

17. The image-forming device according to claim 16, wherein the sheet member has a shape corresponding to a shape of the seal contacting surface.

18. The image-forming device according to claim 10, wherein the sheet member is formed of a PET film.

* * * * *

UNITED STATES PATENT AND TRADEMARK OFFICE

CERTIFICATE OF CORRECTION

PATENT NO. : 7,643,771 B2
APPLICATION NO. : 11/442415
DATED : January 5, 2010
INVENTOR(S) : Hiroya Fukuta It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 724 days.

Signed and Sealed this

Sixteenth Day of November, 2010

David J. Kappos

David J. Kappos
*Director of the United States Patent and Trademark Office*